US006629799B2

(12) United States Patent
Flores, Jr.

(10) Patent No.: US 6,629,799 B2
(45) Date of Patent: Oct. 7, 2003

(54) BRISTLED SOAP DISPENSER

(76) Inventor: Eustacio R. Flores, Jr., 200 Concord St., St. Paul, MN (US) 55107

( * ) Notice: Subject to any disclaimer, the term of this patent is extended or adjusted under 35 U.S.C. 154(b) by 34 days.

(21) Appl. No.: 09/917,558

(22) Filed: Jul. 27, 2001

(65) Prior Publication Data

US 2002/0014256 A1 Feb. 7, 2002

Related U.S. Application Data

(60) Provisional application No. 60/221,084, filed on Jul. 27, 2000.

(51) Int. Cl.[7] ..... A46B 11/04

(52) U.S. Cl. ..... 401/270; 401/6; 401/188 R; 15/104.92

(58) Field of Search ..... 401/270, 278, 401/282, 183, 184, 185, 187, 188 R, 6; 15/104.92, 159.1, 160, 168, 169, 171, 184

(56) References Cited

U.S. PATENT DOCUMENTS

| | | | | |
|---|---|---|---|---|
| 1,194,642 A | * | 8/1916 | Kleeberg | 401/270 |
| 1,287,487 A | | 12/1918 | Smith | |
| 1,292,982 A | | 1/1919 | Wolf | |
| 2,958,885 A | | 11/1960 | Donney | |
| 3,969,026 A | | 7/1976 | Johnson | |
| 4,074,944 A | * | 2/1978 | Xavier | 401/182 |
| 4,906,118 A | | 3/1990 | Crooks | |
| 5,177,829 A | | 1/1993 | Simpson | |
| 5,221,506 A | | 6/1993 | Dulin | |
| 5,321,064 A | | 6/1994 | Vaidya et al. | |
| 5,446,078 A | | 8/1995 | Vaidya et al. | |
| 5,944,437 A | | 8/1999 | Heller | |
| 6,227,740 B1 | * | 5/2001 | Stear et al. | 401/188 R |

FOREIGN PATENT DOCUMENTS

| | | |
|---|---|---|
| FR | 1025845 | 1/1953 |

* cited by examiner

*Primary Examiner*—David J. Walczak
(74) *Attorney, Agent, or Firm*—Merchant & Gould P.C.

(57) ABSTRACT

A self-contained soap dispensing apparatus having a hollow body with an inner chamber for retainment of liquid soap, an outer surface, and passages or ducts connecting the inner chamber to the outer surface which has bristles thereon. A pump within the inner chamber allows soap to flow from the inner chamber to the outer surface on demand. The soap dispensing apparatus is readily portable and can be used in a wide variety of locations, such as an automobile, an airplane, an RV, and the like.

9 Claims, 2 Drawing Sheets

BRISTLED SOAP DISPENSER

Priority under 35 U.S.C. §119(e) is claimed to provisional application having Ser. No. 60/221,084, filed on Jul. 27, 2000, entitled "Hand-Soap Dispensing System". The complete disclosure of application Ser. No. 60/221,084 is incorporated herein by reference.

FIELD OF THE INVENTION

The present invention relates to a self-contained washing apparatus. In particular, the washing apparatus has a soap dispensing device and a surface with which to cleanse the surface being washed.

BACKGROUND

With the growing awareness regarding the spread of diseases in today's society, cleanliness has gained high importance. In many occupations, washing of the hands is mandated either by state or federal law; for example, employees in the restaurant business are required to wash their hands with soap and water after using the rest room. Food service employees are required to wash their hands after handling money. Even if not required, many people are concerned about the cleanliness of their hands after doing common activities, such as opening doors, holding handrails, and even touching items that have been touched by other people. This concern is based on the desire to minimize the spread of bacteria, viruses, and other contaminants that can spread deadly diseases, or even common ailments such as colds.

According to an article written by O. Peter Snyder of the Hospitality Institute of Technology and Management regarding "Safe Hands" Hand Wash Program for Retail Food Operations, results from numerous extensive studies have revealed that washing hands with a detergency (lathering ability) type hand soap and soft fingertip scrubbing brush, verses hand washing without brush, can decrease the amount of transient pathogenic microorganisms, especially around and under fingernails where the highest and most difficult to remove microbial population is harbored, by 350 times.

The fact of the matter is that food borne illnesses continue to be a serious problem in the retail food industry because of individuals who do not properly wash their hands. In the home also, children are exceptionally vulnerable to bacterial transfer because of their inability to thoroughly wash hands and scrub fingertips.

Even with all the anti-bacterial soap products in public restrooms and in the home, when it comes to washing hands, people, especially children, nevertheless are not provided in a convenient, and consistent manner, the optimal variables that have been determined to drastically keep us healthy.

The present invention provides a simple and convenient system for washing one's hands and other body features.

SUMMARY OF THE INVENTION

The present invention relates to a portable soap dispensing apparatus that is a self-contained system for washing or cleaning a surface. The soap dispensing apparatus includes a source of liquid soap and a feature to provide suds or lather. Further, the apparatus includes a textured surface to facilitate the removal of dirt and other impurities from the surface being washed. This soap dispensing apparatus can be used for washing hands or any other part of the body, and is convenient to use because the soap is contained in a portable dispenser.

Liquid soap is contained within a flexible, preferably conformable body or housing that provides the overall structure to the apparatus. The body can be made from a polymeric material, such as polyurethane. Preferably, the polymeric material is a foam material, either open celled or closed celled. In some embodiments, a cellulose material can be used. A biodegradable polymeric material can also be used for the body.

Positioned on at least a portion of the outer surface of the housing can be bristles, which facilitate removal of dirt from the surface being washed. In some embodiments, a screen or mesh material can be provided to improve the foaming or lathering properties of the soap as it exists the housing.

The soap used in the system can be any liquid soap, such as an anti-bacterial or antiseptic soap. It one preferred embodiment, the soap provided is a biodegradable soap that does not leave toxic or other contaminants in the water. In some preferred embodiments, the soap is used without the presence of water, and the used soap evaporates without the need for wiping.

The soap dispensing apparatus can have any shape and size, but is preferably one that is easily handleable and preferably portable. The apparatus is preferably shaped to be readily graspable. In a preferred embodiment, the apparatus is shaped and sized to easily fit within the palm of a person's hand.

This soap dispensing apparatus is easy to use in any location. In one embodiment, the soap dispensing apparatus is conveniently positioned close to, and preferably under, the faucet of a sink or other water source. In another embodiment such as when a self-drying soap is used, the soap dispensing apparatus is available in locations having no or low water availability, such as airplane lavatories or desert areas where water is a commodity.

DETAILED DESCRIPTION

Figure 1:
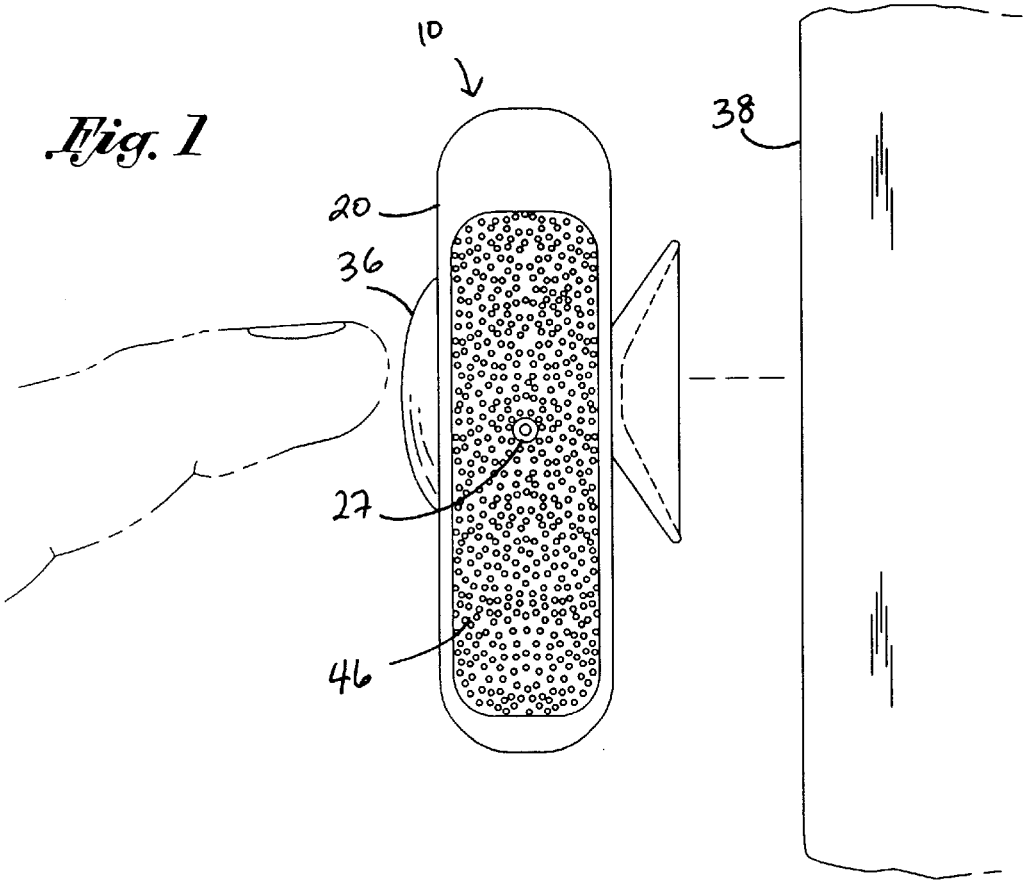
FIG. 1 is a side perspective view of a soap dispensing apparatus according to the present invention in alignment for attachment to a surface.
Figure 2:
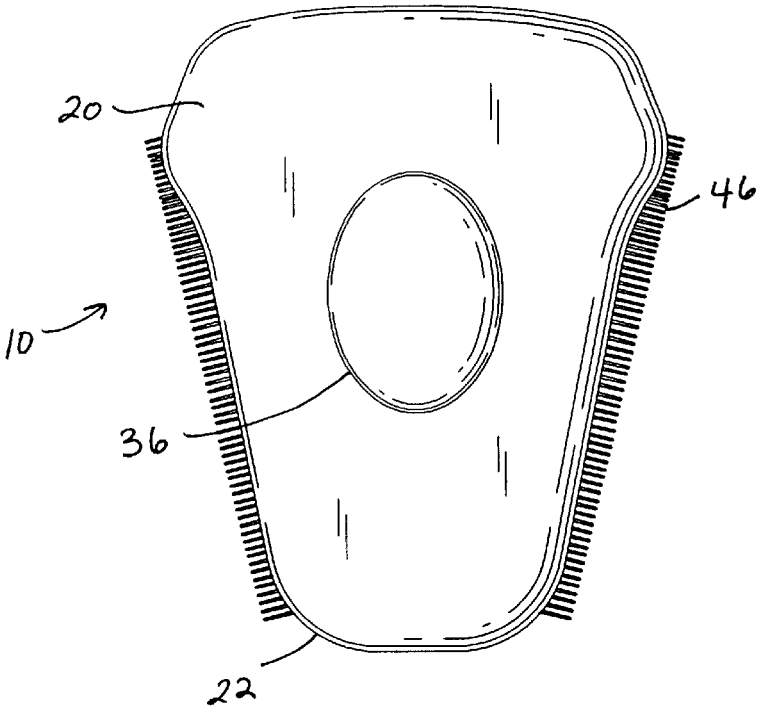
FIG. 2 is a front plan view of the soap dispensing apparatus of FIG. 1.

Describing the soap dispensing apparatus of the present invention in detail, reference is made to the attached figures. FIG. 1 illustrates a perspective side view of a soap dispensing system 10 of the present invention and FIG. 2 shown a front view. In the shown view of FIG. 1, soap dispensing system 10 is in an upright position and ready to be attached to an inside surface of a sink wall 38.

Figure 3:
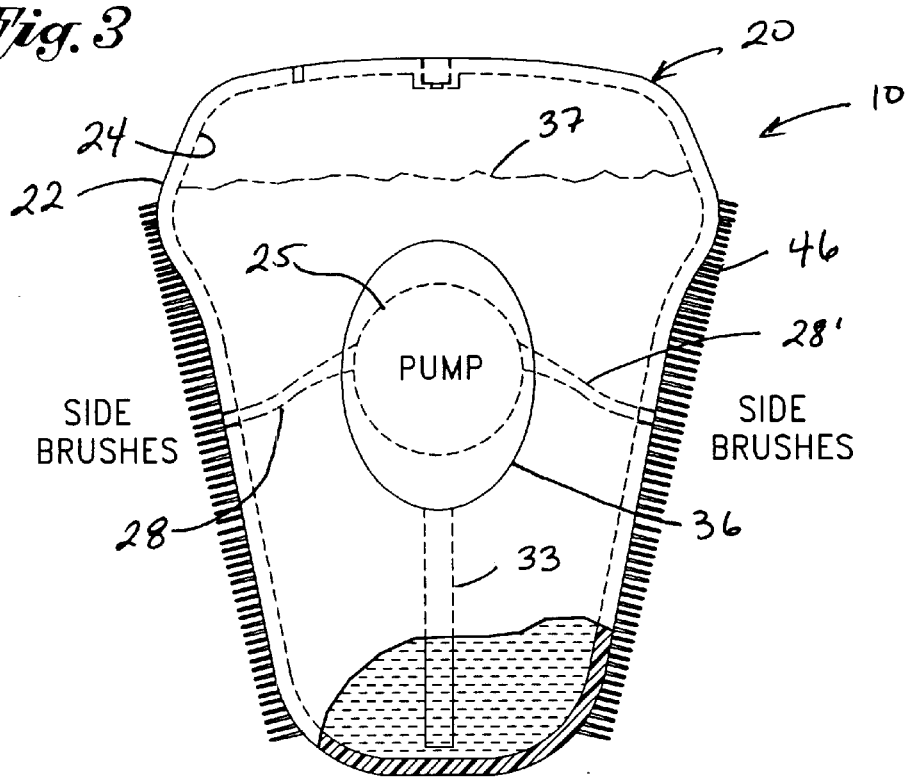
FIG. 3 is a partial cross-sectional view of the soap dispensing apparatus of FIGS. 1 and 2, showing the internal features of the soap dispensing apparatus in phantom.
Figure 4:
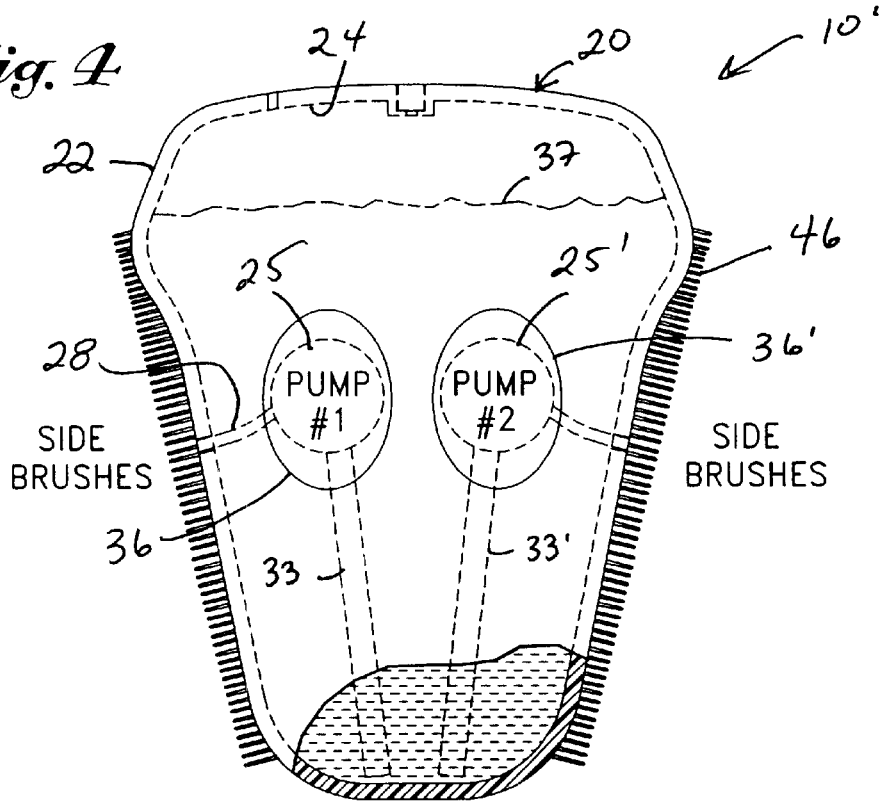
FIG. 4 is a partial cross-sectional view of a second embodiment of a soap dispensing apparatus according to the present invention, showing the internal features.

Soap dispensing system 10 is formed by a hollow body 20 having an outer surface 22 and an inner chamber 24, shown in FIG. 3. Inner chamber 24 is constructed to store a liquid 37, such as liquid soap, as shown in FIGS. 3 and 4.

Body 20 may have any contour or shape for example, a sphere, oblong, heart-shaped, conical, pyramidal, or any shape tat can be easily grasped in one's hand, particularly in wet environments. Body 20 may includes indentations, depressions, or other features that facilitate gripping. Body 20 could also be formed in any of a variety of popular shapes, such as a Mickey Mouse® head shape, and the like. It may be desired to have a shape that has a downward taper, such as a cone, pyramid, or heart, so as to facilitate drainage of the soap to a lower or lowermost portion of the body 20. A flat top or side portion may be desired to facilitate fitting system 10 against a surface. Additionally or alternately, body 20 may be configured to deflect the upward spraying of soap from bristles.

At least a portion of outer surface 22 is a textured surface, used to facilitate removal of dirt and grime from desired surfaces, such as a person's hands. The textured surface is preferably positioned at the sides of the body 20, and may be positioned around the entire circumference of the body; these are the positions where the most effective scrubbing would occur. The textured surface includes regular or irregular shaped protrusions, nibs, nubs, or other three-dimensional features. Preferably and typically, outer surface 22 has a plurality of bristles 46 extending therefrom.

Bristles 46 improve and facilitate the removal of dirt, grime, and unseen bacteria from crevices from the surface being washed, such as the hands. Bristles 46 are also helpful in foaming or lathering soap 37.

Bristles 46 can have any cross-sectional area, such as circular, square, triangular, etc., and may have any surface features, for example, tapered, barbed, feathered, etc. Bristles 46 may be hollow, partially hollow, or have a passage extending therethrough. Bristles 46 can be present over the entire surface 22 or may be only on the sides or edges; preferably bristles 46 are present at the body sides in a fingertip scrubbing area. In some embodiments, bristles may be removable and replaceable.

Body 20 further includes a plurality of passages or ducts 28 extending through the wall of body 20 to provide fluid communication between inner chamber 24 and outer surface 22. In some embodiments, ducts 28 may merely be pores or other passages in body 20. Ducts 28 lead to apertures 27 in outer surface 22. The position of ducts 28 and apertures 27 will vary depending on the specific location of protrusions or bristles 46 on outer surface 22, however ducts 28 will generally provide a path for fluid 37 to flow from chamber 24 to outer surface 22. One or multiple apertures 27 may be present for each plurality of bristles 46.

To facilitate the flow of soap from chamber 24 to outer surface 22, system 10 includes a pump 25 within body 20. Pump 25 can be any typical off-the-shelf simple, mechanical pump or other type of liquid source actuator. FIGS. 3 and 4 illustrate two embodiments of system 10, 10', respectively, showing two pump configurations. In FIG. 3, system 10 includes a pump 25; in FIG. 4, system 10' has pump 25 and a second pump 25'. Preferably, second pump 25' is the same make and model as pump 25.

In each embodiment, a hollow shaft or other conduit 33 extends from a lower or lowermost area of chamber 24 and connects to the inlet of pump 25. The flow path of liquid soap 37 in each system 10, 10' is essentially the same: soap 37 is sucked or otherwise urged from inner chamber 24 through shaft 33, 33' to and through pump 25, 25' and continues out through ducts 28, 28' to aperture 27. It is understood that a single pump 25 may be configured to have multiple inlet shafts 33 and/or multiple outlet ducts 28 connected to it.

Pump 25, 25' can be actuated or engaged manually by depressing a button 36, switch, or other feature on body 20. Preferably, button 36 is sufficiently sensitive to allow a small child to activate pump 25, 25' with a slight pressure front a finger or palm of the hand. Although system 10' is illustrated having two buttons 36, 36', the soap dispensing system could be configured so that one button 36 actuates both pumps 25, 25'. Alternately, pump 25,25' can be activated merely by squeezing or otherwise applying pressure to body 20.

Soap dispensing system 10 is preferably made from a conformable, pliable material, for example, a polymeric material such as polyurethane, polyethylene, or maybe even polycarbonate. Cellulosic materials may also be used. In some embodiments, system can be flexible and compressible. A preferred material for body 20 is a water soluble or biodegradable polymeric material. An example of a biodegradable polymer is a composition of starch and polyurethane, such as those taught by U.S. Pat. Nos. 5,321,064 and 5,446,078. By using a biodegradable material to produce body 20 of soap dispensing apparatus 10, body 20 can be discarded after use, with minimum concerns of deleterious effect on the environment. If a water soluble polymer is used, such as polyvinyl acetate, body 20 will slowly dissolve, leaving minimal material to discard. Preferably, body 20 is made by a molding process, such as injection molding.

Soap dispensing system 10 may be opaque or transparent and may be adorned with various decorations, decals printing and the like. Outer surface 22 may have printing or indicia such as cartoons or other children's characters (such as Bugs Bunny®, Mickey Mouse®, Donald Duck®, Star Wars® characters, Beanie Babies®, and the like), or may have graphics such as company logos, professional sports team logos, or patterns such as a camouflage design, flowers, stripes and the like.

These adornments on body 20 may be permanently affixed to body 20, such as on outer surface 22, or the adornments may be removable and replaceable, for example, when a new cartoon character is desired. Preferably, three-dimensional adornments would be located in areas devoid of bristles 46. Removable adornments can be affixed to soap dispensing apparatus 10 by pressure-sensitive adhesive, snaps, clips, and the like. The adornment can be any decoration, decal, or other item that has aesthetic qualities. In some embodiments, especially those designed for children, the adornment can be a sound-producing item. As an example, the adornment could be a water-activated sound card that plays music or a character's voice or provides praise when activated by scrubbing fingertips against bristles 46.

The soap used in soap dispensing apparatus 10 should be a liquid soap that can be pumped and will readily flow. The viscosity of the soap should not be so high that there are difficulties discharging the soap from apparatus 10, but should not be so low that the soap flows uncontrollably. Usable liquid soaps are commercially available under various brand names such as "Softsoap", "Dial", and the like. The soap used with the apparatus 10 can be an anti-bacterial, antiseptic or other soap that disinfects and/or sanitizes, and can include any lubricants or emollients as moisturizers. Preferably, the soap is non-toxic to wildlife. Soaps having good foaming characteristics are preferred in some systems. In some embodiments, it is desired to use a soap that does not require the use of water; that is, the soap either evaporates or soaks into the surface being washed, such as the hands.

Soap dispensing system 10 is preferably a disposable item that is discarded after liquid soap 37 has been used. However, in some embodiments, it be may be desired to refill soap dispensing system 10 after the initial soap supply 37 has been used.

To use soap dispensing system 10, soap dispensing system 10 can be suspended from a sink fixture, such as the faucet, or from a sink wall 38 as shown in FIG. 1. In FIG. 1, a suction cup is shown, although other attachment devices, such as a clip, hanger, and the like can be used. A person desiring to wash their hands activates pump 25, thereby forcing an amount of liquid soap 37 from inner chamber 24 onto outer surface 22. Preferably, the discharge of soap stops when pressure is removed from body 20. Bristles 46 help to remove caked on grime and dirt from hands and under fingernails.

The ease of actuating pump 25 to obtain soap 37 makes system 10 extremely helpful to someone who has single use only one arm or hand, for example, an amputee or person with a broken arm.

A clip can be designed onto the soap dispensing system 10, so that it can be conveniently positioned, attached, and readjusted, such as on a cabinet door, towel rack, or the like. In some embodiments, the holder can be designed to clip onto an article of clothing, such as a belt. With a snap-on, clip feature, campers, hikers, hunters, fishermen, for example, could easily attach the system to their backpack, waistbelt, diaper bag, etc.

It is also foreseen that the soap dispensing apparatus of the present invention may be designed for use for washing other items, such as car tires, pots and pans, ceramic tile in baths and showers, and the like. The soap dispensing apparatus can, of course, be used in any conventional washing locations, such as a bathroom, kitchen, laundry room, and the like. Examples of locations that would benefit by using a soap dispensing apparatus of the present invention include locations with low or no available water, such as portable toilet stalls, airplane lavatories, RVs or other camping and hiking situations. The apparatus is particularly useful when water is a scarce commodity and cannot be wasted for washing, such as in desert locations, third-world countries, and area in a state-of-emergency.

It is to be understood, however, that even though numerous characteristics and advantages of the present invention have been set forth in the foregoing description, together with details of the structure and function of the invention, the disclosure is illustrative only, and changes may be made in details, especially in matters of shape, size and arrangement.

What is claimed:

1. A soap-dispenser apparatus comprising:

(a) a compressible body having an outer surface and an inner chamber, the outer surface adapted for attachment to a surface and having a first surface and an opposite second surface, the surfaces adapted to contact and conform to surfaces to be washed;

(b) a first duct and a second duct extending from the inner chamber to the first surface and the second surface, respectively;

(c) a pump within the inner chamber in fluid connection to a quantity of soap within the inner chamber, the pump further in fluid connection with the first duct and the second duct; and (d) a first plurality of bristles positioned on the first surface and a second plurality of bristles positioned on the second surface, the first duct and the second duct terminating at the first plurality of bristles and the second plurality of bristles, respectively.

2. The soap-dispenser apparatus according to claim 1, wherein the body comprises a biodegradable polymeric material.

3. The soap-dispenser apparatus according to claim 2, wherein the biodegradable polymeric material comprises starch and polyurethane.

4. The soap-dispensing apparatus according to claim 1 further comprising a pump actuator on the outer surface of the body adapted for actuating the pump.

5. The soap-dispensing apparatus according to claim 1 further comprising an attachment device for attaching the apparatus to a surface.

6. The soap-dispensing apparatus according to claim 5 wherein the attachment device is a suction cup.

7. The soap-dispensing apparatus according to claim 1 wherein the compressible body comprises a closed cell foam material.

8. The soap-dispensing apparatus according to claim 1 wherein the compressible body comprises a polyurethane material.

9. The soap-dispensing apparatus according to claim 1 further comprising indicia on the outer surface.

* * * * *